US007832466B2

(12) United States Patent
Al-Hashash

(10) Patent No.: US 7,832,466 B2
(45) Date of Patent: Nov. 16, 2010

(54) WATER SUPPLY SYSTEM

(76) Inventor: Abdullah Ahmad Al-Hashash, Block 3, Ahmed Alghanim St., Avenue 35, House 39, Abdullah Salem Area (KW)

( * ) Notice: Subject to any disclaimer, the term of this patent is extended or adjusted under 35 U.S.C. 154(b) by 984 days.

(21) Appl. No.: 11/564,668

(22) Filed: Nov. 29, 2006

(65) Prior Publication Data

US 2008/0120986 A1 May 29, 2008

(51) Int. Cl.

| | |
|---|---|
| ***G05D 23/00*** | (2006.01) |
| ***F25B 29/00*** | (2006.01) |
| ***F25B 13/00*** | (2006.01) |
| ***F25B 27/00*** | (2006.01) |
| ***F25D 17/02*** | (2006.01) |

(52) U.S. Cl. ..... 165/287; 165/61; 165/62; 165/63; 165/64; 165/240; 62/118; 62/159; 62/160; 62/238.7; 62/324.1; 62/324.4; 62/324.6

(58) Field of Classification Search ..... 165/240, 165/61, 62, 63, 64; 62/159, 160, 118, 238.7, 62/324.1, 324.4, 324.6, 260

See application file for complete search history.

(56) References Cited

U.S. PATENT DOCUMENTS

| | | | | |
|---|---|---|---|---|
| 3,333,438 | A * | 8/1967 | Benua et al. | 62/395 |
| 3,548,923 | A * | 12/1970 | Kunihiko et al. | 165/236 |
| 4,168,745 | A * | 9/1979 | Lastinger | 165/164 |
| 5,220,807 | A * | 6/1993 | Bourne et al. | 62/238.6 |
| 2005/0150650 | A1* | 7/2005 | Helt | 165/240 |
| 2006/0011149 | A1* | 1/2006 | Stevens | 122/19.2 |

* cited by examiner

*Primary Examiner*—Frantz F Jules
*Assistant Examiner*—Travis Ruby
(74) *Attorney, Agent, or Firm*—Lowe Hauptman Ham & Berner, LLP

(57) ABSTRACT

A water supply system includes a main water tank and a sub-tank of smaller dimensions than the main tank for supplying hot and cold water for household use. The sub-tank is surrounded by a tubular coil of refrigerant in contact with the sub-tank, a layer of insulation and an outer wall for maintaining the insulation in place and protecting the tubular coil and sub-tank from being damaged. A water heater is disposed in or below a lower part of the tank and a three-way switch is provided for selecting heating or refrigeration during different seasons of the year.

1 Claim, 4 Drawing Sheets

WATER SUPPLY SYSTEM

FIELD OF THE INVENTION

This invention relates to a water supply system and more particularly to a water supply system for delivering hot or cold water from a single source.

BACKGROUND FOR THE INVENTION

Heat pump water heaters are well known. For example, a United States patent of Disco, U.S. Pat. No. 4,290,275 discloses a water storage heater having a heat pump including a compressor, a condenser and an evaporator. The condenser is arranged in heat relationship with a wall of an inner hot-water container. An outer shell is spaced from and surrounds the inner container to provide an interspace, at least part of the outer shell is constituted by the evaporator. Apertures are also provided in the outer shell to provide for air circulation through the interspace.

A more recent patent of Pardo, U.S. Pat. No. 5,281,426 discloses an automatic heating and cooling tank system for heating and cooling food. The system includes an apparatus for uniformly cooking foods and rapidly cools the cooked foods to reduce spoilage. Food packages are placed on trays and the trays are inserted in a transportable rack. The rack is then loaded into a cooking tank. A pump continuously circulates hot water through a conduit from a heat exchanger to the tank to cook the food and return the hot water to the heat exchanger. A control mechanism determines and controls the temperature of the water and monitors the temperature of the food to control the length of time the heated water is applied. After the food has been cooked and pasteurized, cold water is rapidly supplied to the tank to quickly cool the cooked product. The continuous circulation of water during the heating mode provides uniform cooking with precise temperature control and the circulation during the cooling mode provides for rapid cooling so as to reduce spoilage.

A water heater/cooler is disclosed in a U.S. Patent Application Publication No. 2006/0011149 A1 of Stevens. As disclosed, a water heater having a water tank with a wall formed from a material having heat transfer properties, a tube which carries a refrigerant fluid is applied externally about the tank wall and a heat/conductive material is co-extensive with the length of the tube to allow the tube to be in heat/conductive contact with the tank wall. At least one layer of material is tightly wrapped about the tank wall and the tube.

Notwithstanding the above, it is presently believed that there is a need and a potential market for an improved water supply system in accordance with the present invention. There should be a demand because such systems enable a standard water heater to serve a dual function i.e. function as a heater in winter and a cooler in summer for water used for everyday household purposes. The system in accordance with the present invention provides an inexpensive and practical way to cool water in desert like areas in the summer months instead of cooling a larger water tank that may be placed on the roof of a house. In winter, the same system may be used to provide heated water.

BRIEF SUMMARY OF THE INVENTION

In essences, the present invention contemplates a water supply system for providing a supply of hot or cold water for everyday household use. The system includes a main water tank which in many cases is disposed on the roof of the dwelling and exposed to the environment. Tanks of this type are commonly used in the Middle East where the summers are quite hot, but may also be used in other desert like areas. The system also includes a sub-tank of smaller dimensions than the main tank connected to the main tank for receiving a supply of water from the main tank. The sub-tank is typically disposed within the dwelling and includes a wall formed of heat transferable material such as copper or other suitable metal and in cases may be glass lined. A coiled tube extends around and in contact with the sub-tank from a bottom portion to an upper portion of the sub-tank. The coil may for example include a plurality of connected spiral rings that are preferably between about 1 to 4 inches apart. The coiled tube includes a mass of refrigerant such as Freon and is connected to a refrigeration unit in a conventional manner. The refrigeration unit is connected to a source of electricity for cooling water in the sub-tank. An outer wall surrounds the sub-tank and a layer of insulation is disposed between the coiled tube and the outer wall. A heater that is also connected to a source of electricity is disposed within a lower part of the sub-tank for heating water in the sub-tank. The heater and refrigeration unit are connected to a source of electricity by a connecting means such as a three-way switch to turn the heater or the refrigeration unit to an on position or to turn both units off.

The invention will now be described in connection with the accompanying drawings wherein like reference numerals have been used for like parts.

DESCRIPTION OF THE PREFERRED EMBODIMENTS OF THE INVENTION

High temperatures are frequently encountered during the summer in Kuwait, other Gulf Coast countries as well as in certain areas of the United States. In some areas, particularly in the Middle East, it is also common to maintain a water storage tank on the roof of a building. The problem is that water in the rooftop tank becomes quite hot when outside temperatures approach and exceed 120° F. The problem of high temperature is exacerbated when the rooftop tanks are exposed to the direct rays of the sun. Accordingly, it is desirable to cool the water for normal household use. However, during parts of the year when the temperatures are moderate, it is desirable to heat the water for normal household use.

Figure 1:
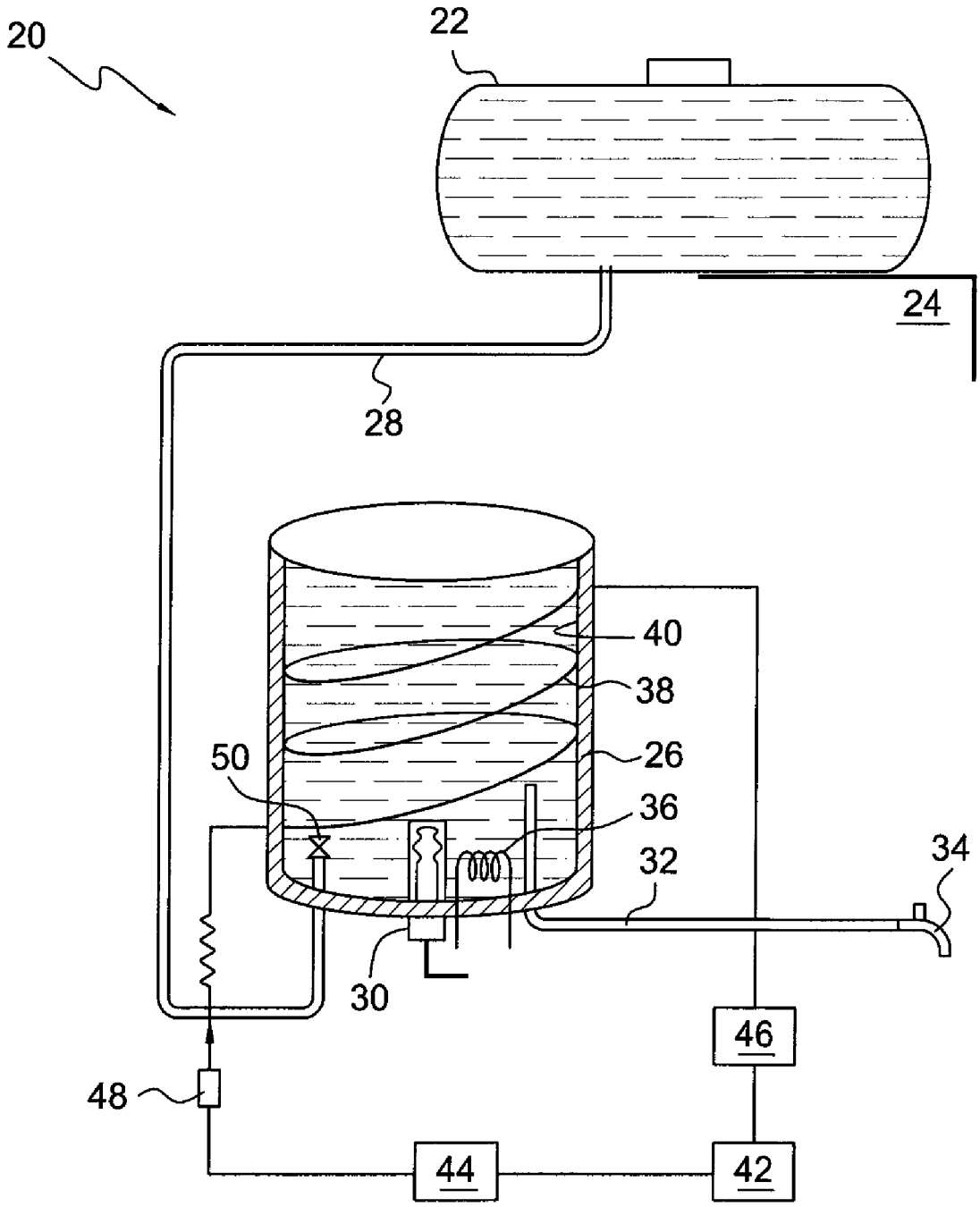
FIG. 1 is a schematic illustration of a water supply system in accordance with the present invention.
Figure 2:
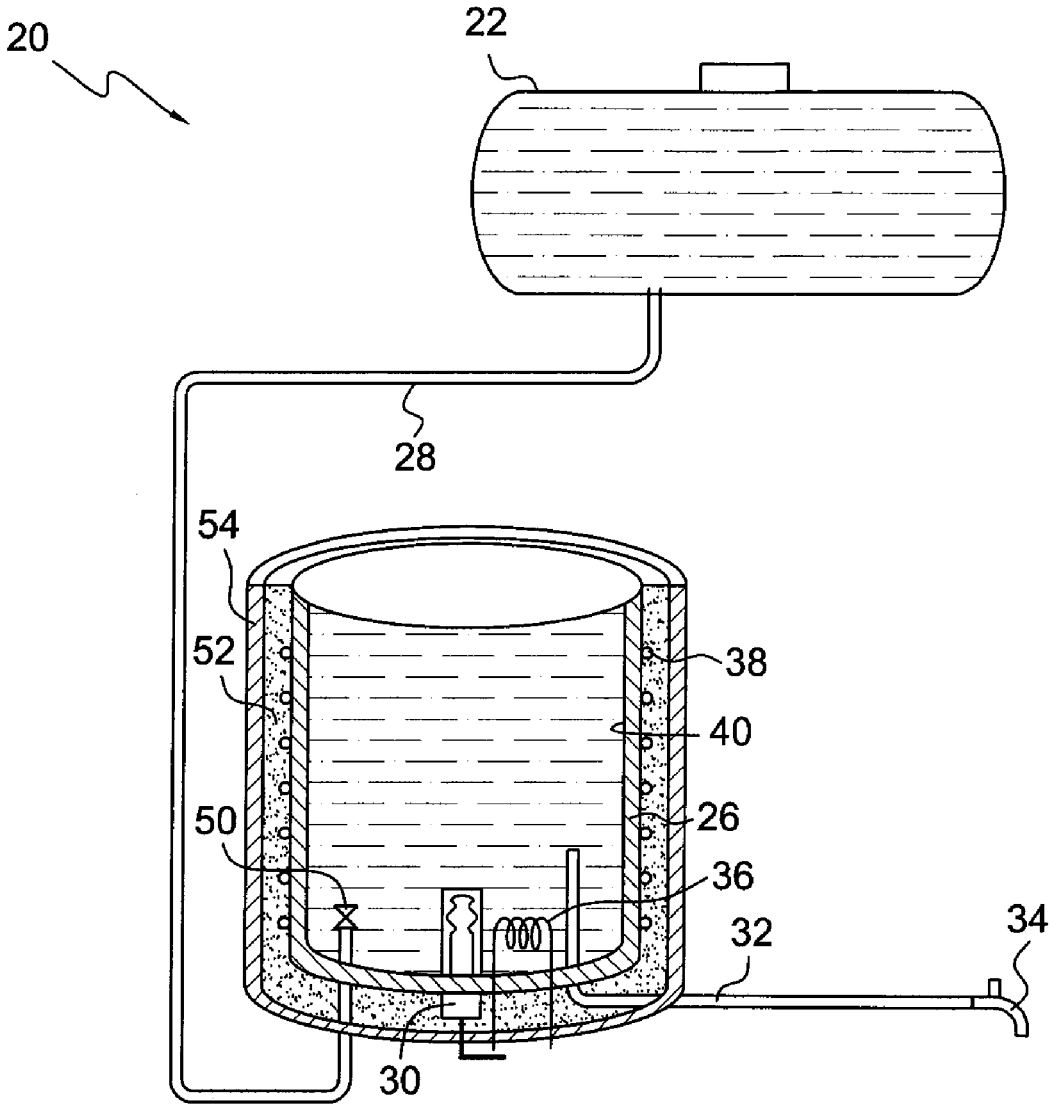
FIG. 2 is a schematic illustration of a heating portion of a water supply system as shown in FIG. 1 but without the refrigeration portion of the system.

Accordingly, a water supply system in accordance with the present invention is adapted to heat and cool water dependent on climate conditions and on the needs of a household. For example, a water supply system 20 as illustrated in FIGS. 1 and 2 include a water supply tank 22 disposed on a roof 24 of a dwelling. The system 20 also includes a sub-tank 26 which is normally disposed in the dwelling and connected to the tank 22 by a conduit 28 for receiving a supply of water from the tank 22. The sub-tank 26 also includes a safety valve 30 for release of any excess pressure that may build up in the sub-tank 26 and in pipe 32, with a valve means 34 such as a faucet for removing heated or cooled water from the sub-tank 26. An electric heater 36 is also disposed in the bottom of the sub-tank 26 for heating the water during periods of more moderate temperatures.

The water supply system 20 also includes means for cooling the water contained therein during periods of relatively hot weather. For example, a tubular coil 38 surrounds the sub-tank 26 and is in contact with its wall 40. A compressor 42 is operatively connected to the coil 38 and charged with Freon gas. The compressor 42 increases the pressure and temperature so that the Freon gas is turned from its saturated to a super heated gaseous state and feeds the gas to a condenser 44 in a conventional manner.

The condenser 44 wherein the refrigerant discharges its heat to the environment and an expansion valve (not shown) through which the liquid expands from the high pressure level in the condenser to the low pressure level in the cooling pipes i.e. the tubular coil 38. The tubular coil is disposed after the expansion valve and acts as an evaporator and extends from the expansion valve to a liquid receiver 46. A filter 48 clears the cooling circuit of any debris resulting from maintenance and gets rid of any humidity through the use of a silicate disposed in the filter. The gas is conducted through the liquid receiver 46 to separate the gaseous Freon from the liquid Freon so that only Freon in the gaseous state enters the compressor.

In a preferred embodiment of the invention, the cooling tubes i.e. tubular coil 38 which are coiled around the sub-tank 26 are constructed and arranged so that the inlet of the cooling tubes is at the bottom of the sub-tank 26 and the outlet is at the top. Also, the electric heater 36 is disposed in a lower portion of the sub-tank 26.

FIG. 2 illustrates the main water supply tank 22 and the sub-tank 26 and shows the tubular coil 38 in contact with an outer surface of an inner wall of the sub-tank 26. The inner wall of the sub-tank 26 and tubular coil are then covered by an insulation layer 52 and surrounded by an outer wall 54. In essence the sub-tank 26 is constructed in a similar manner as a conventional hot water heater but includes the tubular coil 38 between an outer surface of the sub-tank 26 and the layer of insulation 52 all of which is held in place by an outer wall 54. In essence the sub-tank 26 is constructed in a similar manner as a conventional hot water heater but includes the tubular coil 38 between an outer surface of the sub-tank 26 and the layer of insulation 52.

Figure 3:
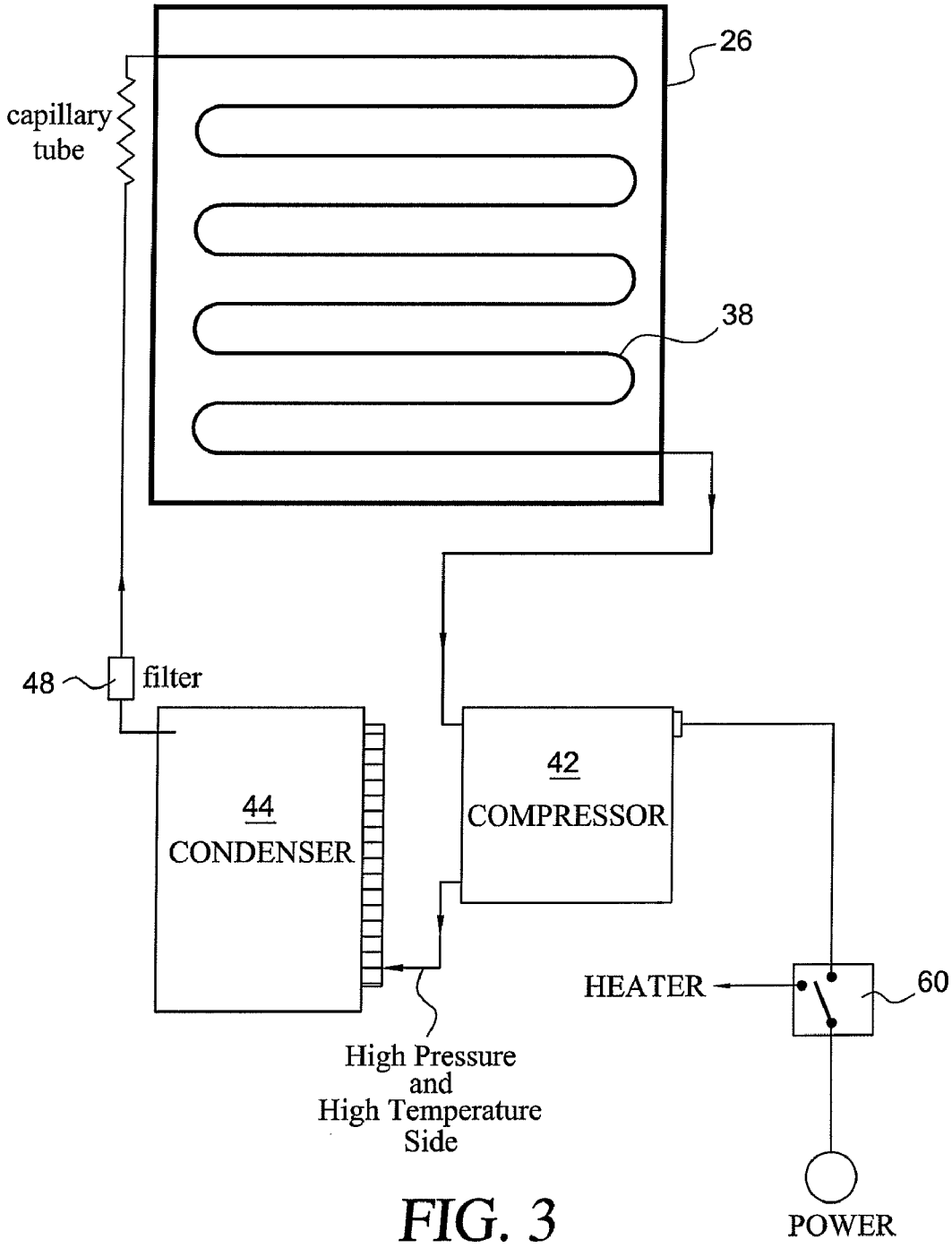
FIG. 3 is a block diagram of a cooling cycle and switch as used in the present invention.
Figure 4:
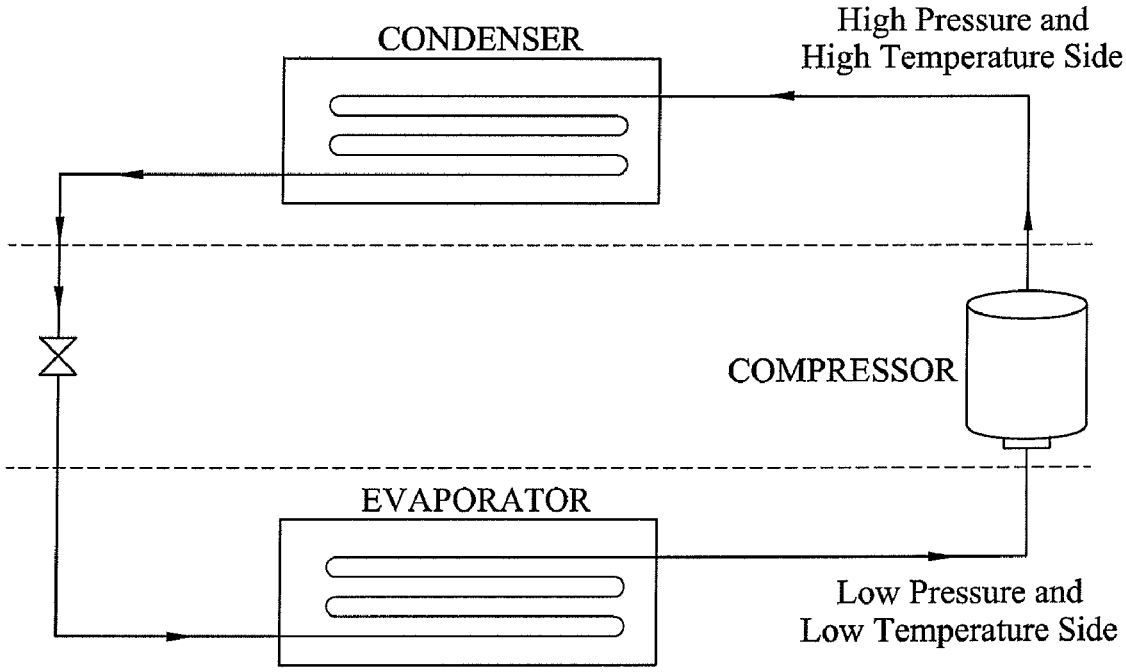
FIG. 4 is a diagram of a refrigeration system as used in the present invention.

FIGS. 3 and 4 illustrate the cooling system as used in the present invention and a three-way switch 60 for activating the cooling system during periods of elevated temperatures or for turning the cooling system off and activating the heater during periods of lower temperatures. In essence, the refrigeration unit may be of any conventional design. The difference is that the sub-tank 26 includes the refrigeration coil 38. A thermostat (not shown) is also provided to maintain the water at a pre-selected temperature during heating and/or cooling thereof.

While the invention has been described in connection with its preferred embodiments, it should be recognized that changes and modifications may be made therein without departing from the scope of the appended claims.

What is claimed is:

1. A water supply system for providing hot or cold water said system comprising a main water tank on a roof of a building for containing a supply of water for everyday household use and a sub-tank in the shape of a right circular cylinder of a smaller diameter than said main water tank disposed in the building, said sub-tank including a lower portion connected to said main tank for receiving water from said main tank, and said sub-tank including a wall formed of heat transferable material, a coiled tube extending around and in contact with said sub-tank multiple times, and a supply of refrigerant disposed in said tube and refrigeration means including a compressor and a condenser connected to a source of electricity for cooling said refrigerant and circulating said refrigerant through said coil to thereby cool water in said sub-tank, an outer wall surrounding said sub-tank and a heater connected to a source of electricity within said lower portion of said sub-tank for heating water in said sub-tank and a three-way switch for selecting a cooling cycle, a heating cycle or an off position in which said sub-tank includes a safety valve and a filter and a silicate disposed in said filter clearing the cooling circuit of any debris resulting from maintenance and getting rid of any humidity through the use of said silicate.

* * * * *